United States Patent [19]

Meylan

[11] 3,938,584

[45] Feb. 17, 1976

[54] APPARATUS FOR COOLING CONTINUOUS CASTINGS

[76] Inventor: Jean-Luc Charles Meylan, 45, Chemin Moise-Duboule, 1211 Geneva, Switzerland

[22] Filed: Sept. 5, 1974

[21] Appl. No.: 503,358

Related U.S. Application Data

[62] Division of Ser. No. 260,773, June 8, 1972, Pat. No. 3,848,656.

[30] Foreign Application Priority Data

June 9, 1971 Switzerland ..... 8423/71

[52] U.S. Cl. ..... 164/283 S; 164/282

[51] Int. Cl.[2] ..... B22D 11/12

[58] Field of Search ..... 164/82, 89, 282, 283 R, 164/283 S

[56] References Cited

UNITED STATES PATENTS

| | | | |
|---|---|---|---|
| 894,410 | 7/1908 | Trotz | 164/283 R |
| 3,191,251 | 6/1965 | Olsson | 164/283 S |
| 3,426,835 | 2/1969 | Michelson | 164/274 |
| 3,614,978 | 7/1968 | Kosco | 164/283 R |
| 3,794,108 | 2/1974 | Koump | 164/283 S |

*Primary Examiner*—Francis S. Husar
*Assistant Examiner*—Gus T. Hampilos
*Attorney, Agent, or Firm*—Haseltine, Lake & Waters

[57] ABSTRACT

Apparatus for continuous casting of metal bars, in which the metal bar is formed in a cooled mould, extracted therefrom by roller trains, cooled during extraction and along its path of extraction the metal bar is subjected to the action of the fluid in an airtight chamber, the fluid having a pressure such as to compensate the hydrostatic internal pressure in the metal bar to reduce pressure and stress on the roller trains.

13 Claims, 13 Drawing Figures

FIG. 7
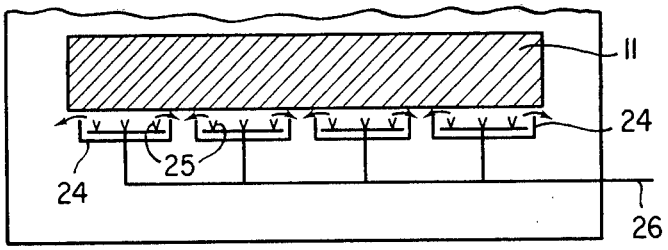
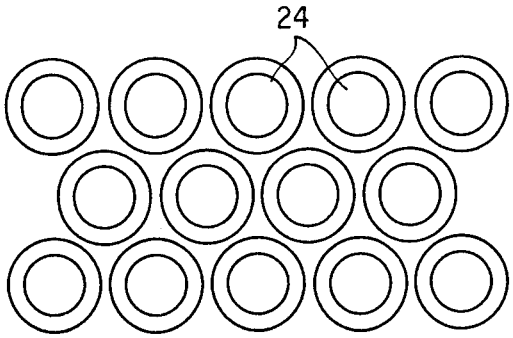
FIG. 8
FIG. 9
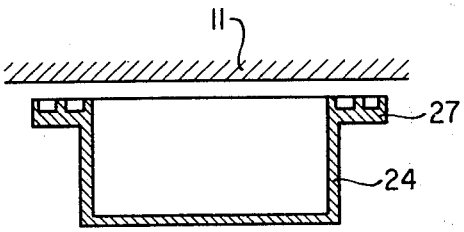
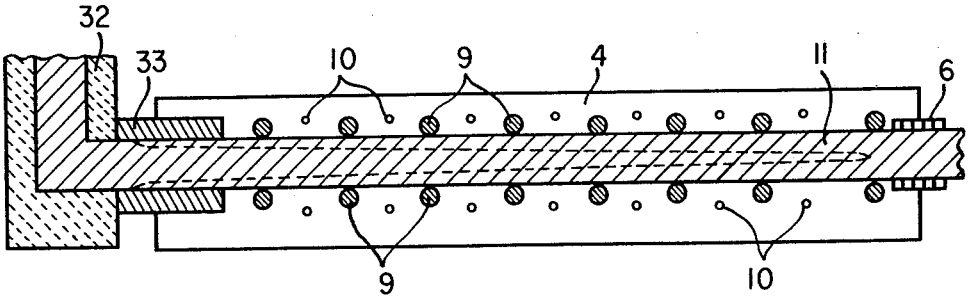
FIG. 13

APPARATUS FOR COOLING CONTINUOUS CASTINGS

CROSS-RELATED APPLICATION

This application is a division of copending application Ser. No. 260,733 filed June 8, 1972, now issued as U.S. Pat. 3,848,656 and claims the priority of the application filed in Switzerland on June 9, 1971.

This invention relates to apparatus for continuous casting of metal strands such as, more particularly steel slabs.

In a conventional process for the production of steel strands the outer portion of the steel is allowed to solidify in a water-cooled copper mould to form a skin of a certain thickness, and the steel strand thus obtained is conveyed along and between two series of rollers while it is being cooled until it has completely solidified. The cooling is effected first by means of water jets and then by natural heat radiation and convection. The path of the steel rod, which initially is inclined and curved, is gradually diverted into a horizontal plane by the roller trains.

This process has, however, some disadvantages such as:

1. as it is necessary to use a great many heavily loaded rollers, the apparatus required for carrying out the process is heavy and bulky;
2. the life of the rollers is limited to but a few days;
3. the metal strand tends to bulge between the rollers due to the effect exerted by the hydrostatic ("ferrostatic") internal pressure; the bulging brings about the well known metallurgical disadvantages such as fissures and cracks, etc; in order to reduce the bulging a great number of rollers is required; therefore, a great mechanical force is required to move the metal strand;
4. the surface available between the rollers for cooling the metal strand is limited;
5. the speed of movement of the metal strand is limited to about 1 m/min.

It is an object of the present invention to eliminate the aforementioned disadvantages in continuous casting of metal strands, particularly steel slabs, in which the metal strand is formed in a cooled mould and extracted from the mould by roller trains, the metal strand being cooled during extraction until it has completely hardened. To achieve this object, the present invention contemplates subjecting the surface of the metal bar, all along its path of extraction, to the action of a fluid having about the same pressure as the hydrostatic internal pressure of the metal bar.

Thus, the present invention contemplates counterbalancing the hydrostatic pressure acting on the skin of the metal strand by the pressure of a gaseous medium located outwardly of the metal strand, instead of the rollers used for this purpose in the conventional processes. Consequently, the rollers in the present invention only serve as guide rollers and therefore their number and size may be considerably reduced and they may be spaced further apart. The fluid pressure acting on the surface of the strand reduces the bulging between the rollers and therefore the force required for moving the strand can be considerably reduced, particularly since the rollers are no longer subjected to the hydrostatic internal pressure of the metal strand, acting perpendicularly to their axes. Thereby roller wear is considerably reduced and their life is extended. This further permits increase in their speed of rotation, resulting in an increase of the speed of movement of the metal strand and consequently in an increase of the production capacity.

Although various gaseous mediums may be used, steam is most advantageous as it can be produced at the desired pressure and at low cost by spraying water on the surface of the metal strand. Thus, for example, the heat emanated by a metal slab of 30 × 200 cm, moving at a speed of 1 m/min., permits to produce about 15 kg of steam per second.

Also air may be used as a gaseous medium although its use necessitates the employment of a compressor of a very high power. Also a mixture of air and steam may be used, but such a mixture is less advantageous than pure steam.

The invention contemplates apparatus for continuous casting of strands including a mould, mould cooling means, a set of guide rollers arranged to guide the strand coming out of the mould along a desired path, and means for cooling and advancing the strand along its path, an improvement wherein at least in a portion of the zone of solidification of the strand after the mould, the set of guide rollers is arranged in an airtight chamber provided with injection nozzles for cooling liquid, a seal at each of its ends, and at least one outlet opening equipped with flow control valve means.

The apparatus of the present invention will now be described in detail with reference to the accompanying drawings which schematically show two embodiments of the apparatus with some variations thereof and in which:

FIG. 7 is a schematic transverse section through a particular embodiment of the injection device;

FIG. 8 is a plan view showing the elements of the injection device of FIG. 7;

FIG. 9 is a sectional view, on a larger scale, showing a member of the injection device of FIG. 7;

FIG. 13 is a longitudinal section through a second embodiment of the apparatus comprising only a horizontal portion.

Figure 1:
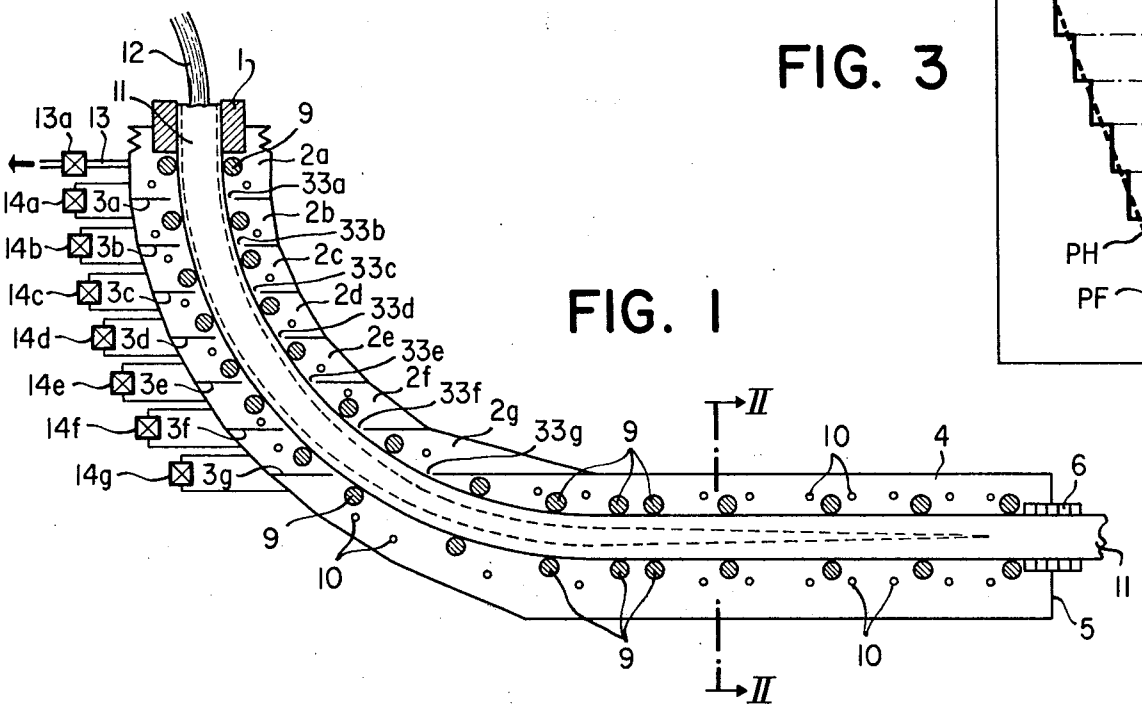
FIG. 1 is a longitudinal sectional view of a first embodiment of the apparatus.

The apparatus shown in FIG. 1 together with a cast metal slab 11 comprises a conventional mould 1 of the type commonly used for continuous casting of steel slabs, an airtight chamber comprising, a series of compartments 2*a* to 2*g* forming an inclined portion of the apparatus and separated from one another by slab encircling parallel horizontal partitions, 3*a* to 3*f*, and a compartment 4 separated from the compartment 2*g* by a horizontal partition 3*g* and forming a horizontal portion of the apparatus. Approximately in their central portion the partitions 3*a* to 3*g* are provided with an aperture 33*a* to 33*g* having the shape of the cross section of the metal slab 11 cast and a size larger by a few millimeters than this cross section so as to provide some limited play for the passage of the metal slab. The compartment 4 is closed at its free end by a wall 5 having an aperture provided with an outlet seal 6 permitting the metal slab 11 to pass freely without any substantial leak of gaseous medium from the interior of the compartment 4 to the outside. The partitions 3*a* to 3*g* are spaced from one another by about 20 centimeters.

Rollers 9 are placed with their axes horizontally in the compartments 2*a* to 2*g* and the compartment 4 to guide and straighten the cast metal slab. The number of rollers 9 may obviously also be different from that shown in FIG. 1, and in particular it may be smaller than that shown, but at any rate it is smaller than the number of rollers in the conventional apparatus for continuous casting of steel slabs. Each of the compartments 2*a* to 2*g* is provided with at least two injection nozzles 10 arranged one on each side of the metal slab 11. The number of injection nozzles 10 in the compartment 4 depends on its length, in the illustrated embodiment there are 20 injection nozzles.

Each of the compartments 2*a* to 2*g* is connected to the adjacent one by a pressure control valve means, comprising a by-pass valve 14*a* to 14*g* in the present case. The compartment 2*a* is provided with a fluid outlet aperture 13 provided with a flaw control valve 13*a*.

In the illustrated apparatus the gaseous medium utilized is steam produced in situ by injection of hot water through the injection nozzles 10 into the compartments 2*a* to 2*g* and 4. The operation of the apparatus is as follows:

By means of a casting ladle, not shown in the drawings, a jet 12 of molten metal, for example, liquid steel having a temperature in the order of 1500°C, is cast into the mould 1. The steel slab coming out of the mould 1 transversing the apparatus shown in FIG. 1 from top to bottom and from left to right, is cooled on its way and thereby solidified progressively from outside toward its inside. When the steel slab leaves the mould 1 it is almost completely liquid apart from a thin deformable skin on its outer surface and when it leaves the apparatus at the outlet seal 6 it has completely solidified into an indeformable rigid block.

On the other hand, in the inclined portion of the apparatus the metal slab is mainly liquid. The portion of the metal bar located between the dash lines shown in FIG. 1 is the liquid sump inner portion of the metal slab.

In the compartments 2*a* to 2*g* and 4 the water injected through the injection nozzles 10 is vaporized on contact with the metal slab 11 and with the walls of these compartments to which some of the heat emitted by the metal slab is transmitted. In this manner in each of the compartments 2*a* to 2*g* and 4 a pressure is produced which is equivalent to the mean value of the ferrostatic pressure of the portion of the metal slab traversing the respective compartment. The temperature of the metal slab in the compartment 2*g* is in the order of 1000°C and its ferrostatic pressure is about 5 to 10 bars. In the compartment 2*a* the hydrostatic pressure of the metal slab is of the order of 1 bar. The pressure of the steam increases progressively by steps from the compartment 2*a* to the compartment 2*g* so as to counterbalance the ferrostatic pressure of the metal slab along its path through said compartments. The temperature at which the water enters each of the compartments is adjusted to a value near the steam saturation temperature corresponding to the pressure required to prevail in the respective compartment, i.e., a value between 100° and 180°C. In this manner any undesired steam condensation is avoided which might occur if an amount of water much higher than the amount of produced steam were injected.

Figure 3:
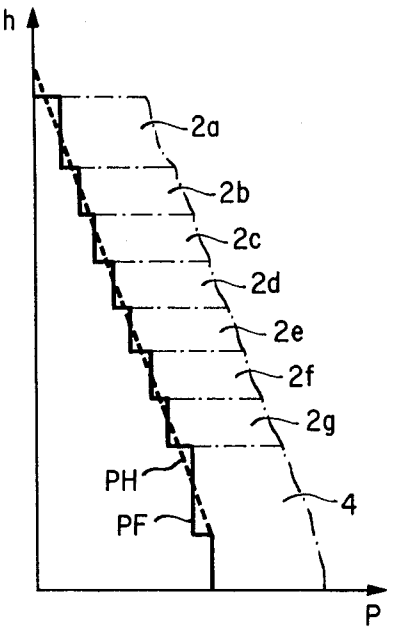
FIG. 3 is an illustrative diagram.
Figure 2:
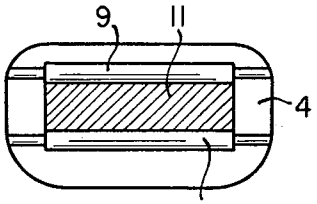
FIG. 2 is a section taken on the line II—II of FIG. 1.

The diagram of FIG. 3 illustrates the internal ferrostatic pressure PH of the metal slab and the pressures of the steam (gaseous medium) PF acting on the metal slab in the various compartments 2*a* to 2*g* and 4 of the apparatus. As shown in FIG. 3, the steam pressure in each compartment is constant and its value corresponds to the mean value of the internal ferrostatic pressure of the portion of the metal slab in the respective compartment.

Figure 4:
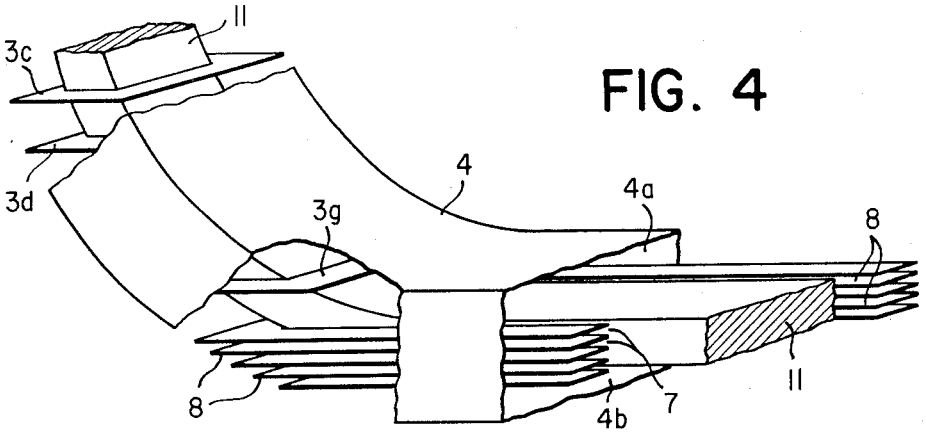
FIG. 4 is a part perspective view of a variation of the apparatus shown in FIG. 1.

The part perspective view of FIG. 4 shows a variation of the apparatus of FIG. 1, in which the space of the compartment 4 which is not occupied by the metal slab 11 is longitudinally divided into two portions, i.e., an upper portion 4*a* and a lower portion 4*b*, by a pressure loss device or dynamic joint formed by a plurality of horizontal partitions 8 which in the illustrated embodiment are five in number and arranged around the metal slab 11 so as to form labyrinths 7. A by-pass pressure control valve 14*h* (FIG. 5) connects the two portions 4*a* and 4*b*.

This variation permits to obtain below the metal slab a gaseous medium pressure different from that above the metal slab. Thus, by producing, for example, below the metal slab 11 a pressure higher than that above the metal slab the latter is still better supported and guided and so the number of guide rollers can be further reduced.

Figure 5:
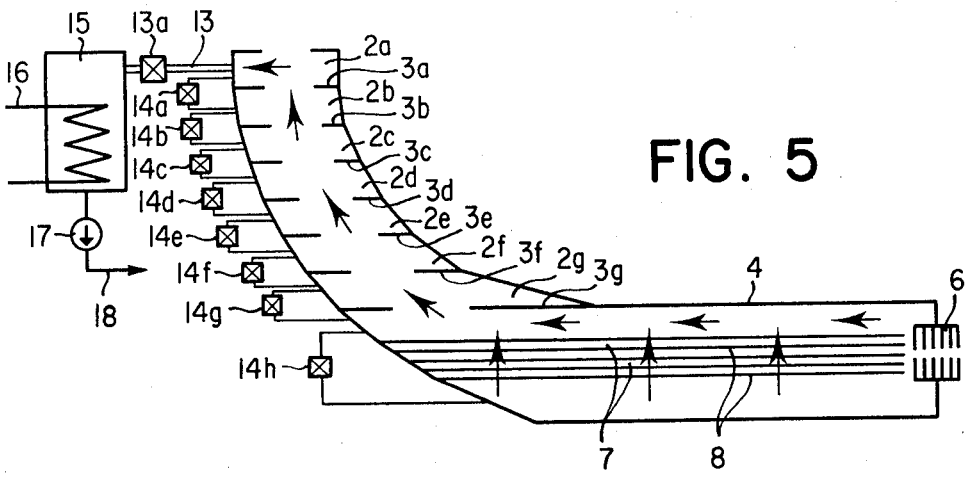
FIG. 5 is a schematic longitudinal section of a variation of the apparatus shown in FIG. 4.

The part view of FIG. 5 shows another variation of the apparatus without the metal strand. In addition to the pressure loss device of the variation described above, this variation comprises a steam recycling system including a condenser 15 provided with a cooling fluid circuit 16, a pump 17 and a conduit 18 for feeding the hot water produced by the condenser 15 to the injection nozzles 10 (not shown in FIG. 5). The arrows indicate the flow direction of the steam in the chamber and that of the water produced by condensation of the steam. The temperature of this water is in the order of 105°C at the outlet from the condenser 15 in which the pressure is therefore slightly higher than atmospheric.

Figure 6:
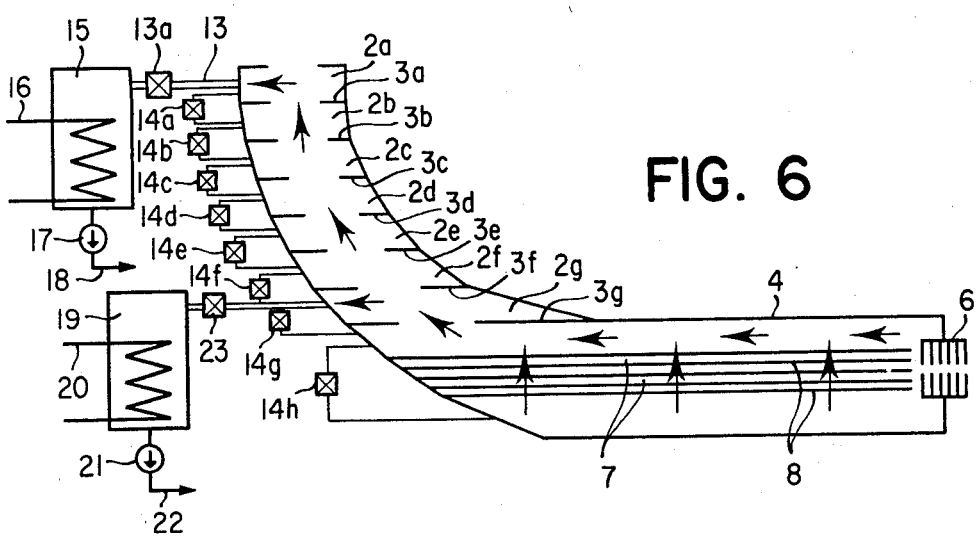
FIG. 6 is a schematic longitudinal section of another variation of the apparatus shown in FIG. 4.

The apparatus shown in FIG. 6 is similar to that of FIG. 5, but comprising additionally a second steam recycling system including a steam condenser 19 provided with a cooling fluid circuit 20, a pump 21 and a conduit 22 for re-introduction of the hot water into the apparatus. A second flow control valve 23 permits steam at high pressure to be removed from the compartment 2*g* and to be introduced into the condenser 19. The water at the outlet of the condenser 19 has a temperature of about 140°C., whereas the temperature of the water at the outlet of the condenser 15 is again 105°C.

The transverse section of FIG. 7 shows a compartment of the apparatus provided with a special type of water injection device formed by injection boxes 24 containing injection nozzles 25 connected through a conduit 26 to the source of water under pressure. The arrows indicate the flow direction of the produced steam. The pressure of the steam in the boxes 24 is higher than the pressure in the rest of the compartment. This injection device permits improvement in the supporting and guiding of the strand and can be used either in all or only some of the compartments of the apparatus. In the horizontal portion of the apparatus formed substantially by the compartment 4 this injection device may be used, for example, only below the strand.

FIG. 8 shows the arrangement of the injection pots 24 with respect to one another. This staggered arrangement avoids the formation of permanent deformations in the skin of the strand. The injection pots 24 may also have a different shape than that shown in FIG. 7, for example, rectangular, oval or some other shape.

FIG. 9 shows an injection box 24 provided with a rim 27 in the form of a labyrinth pressure reducing device which permits a more progressive and regular distribution of the pressure exerted by the steam on the surface of the metal slab 11.

Figure 10:
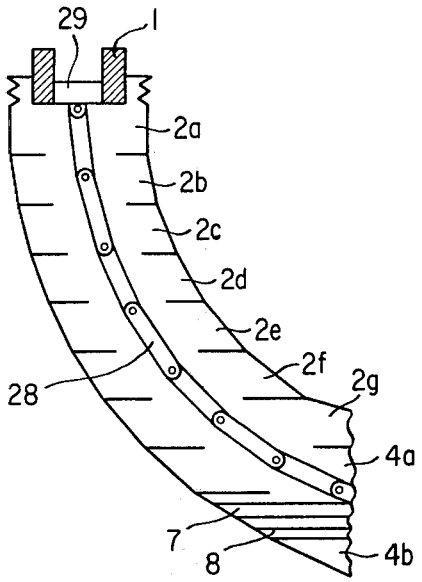
FIGS. 10, 11 and 12 are part longitudinal sections through the apparatus of FIG. 1, illustrating its operation.
Figure 11:
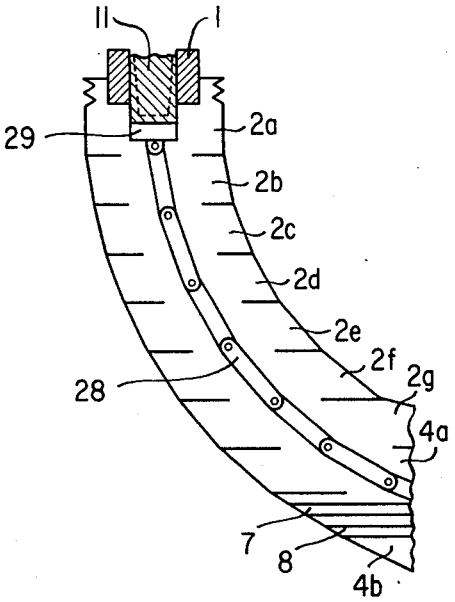
Figure 12:
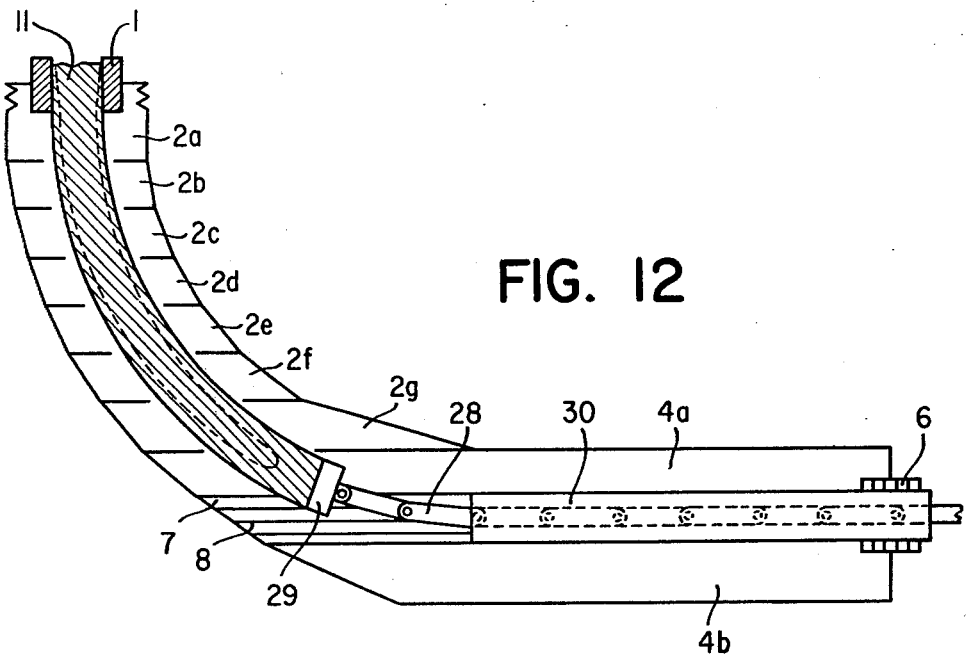

FIGS. 10, 11 and 12 show the means used for setting the apparatus of the present invention into operation. For this purpose an articulated dummy bar 28 is provided which at one end has a dummy bar head 29 with a surface corresponding to the cross section of the metal slab 11. Before starting operation of the apparatus, the head 29 closes the mould 1 as shown in FIG. 10. The other end of the articulated dummy bar 28 is connected to appropriate means, not shown, for exerting a pulling force on the articulated dummy bar 28. In the lower portion of the apparatus, the articulated dummy rod 28 passes along a channel provided in the interior of a rigid rod 30 of the same cross section and weight per unit of length as the metal slab 11. The rigid rod 30 is likewise connected to appropriate means, not shown, for pulling it in the direction of movement of the metal slab 11.

The apparatus operates in the following manner: Initially the apparatus is in the position shown in FIG. 10. Then the mould 1 is filled with steel. The steel is allowed to form on its outer surface a skin which is thick enough to permit the slab 11 to be withdrawn. Then the slab 11 is pulled out while the mould 1 is supplied with a sufficient amount of liquid steel. The pressure in the compartments 2*a* to 2*g* and the compartments 4*a* and 4*b* is adjusted to a value corresponding to that of the ferrostatic pressure of the head of the slab 11. Thus, in the postion shown in FIG. 11, the ferrostatic pressure of the head of the slab 11 in the compartment 2*a* is about 1.2 bars and the pressure in the compartments 2*a* to 2*g* is adjusted to this same value of 1.2 bars. In the position shown in FIG. 12, the head of the slab 11 has reached the compartment 4*a* and pressure in the compartments 2*a* to 2*g* increases by successive increments so as to counterbalance the ferrostatic pressure of the slab 11, the values of this pressure being, for example, 1.2 bars, 1.4 bars, 1.6 bars, 1.8 bars, etc. Thus, the weight of the cast steel slab 11 in each compartment is compensated by the pressure of the gaseous medium and the only force that need be applied is the force required to cause the slab 11 to advance from one compartment to another. When the head of the slab 11 arrives at the point of its path where the horizontal portion thereof meets the curved portion, the rigid rod 30 which hitherto had remained stationary is moved towards the outlet seal 6 and a difference in pressure is produced between the compartment 4*b* and the compartment 4*a*, which difference is sufficient to lift the rigid rod 30 and thus the cast steel slab 11 and is produced by feeding into the compartment 4*b* a fluid under pressure, for example, air or steam supplied respectively by a compressor or an auxiliary boiler, not shown. When the head of the cast steel slab 11 arrives in the vicinity of the outlet seal 6, water is introduced through the injection nozzles 10 (FIG. 1) and the apparatus is operated in the usual manner.

The embodiment of the apparatus shown in FIG. 13 has no curved portion. Instead of the mould 1 of the conventional design this apparatus has a mould composed of a refractory ceramic portion 32 having no particular cooling means, and a portion 33 provided with cooling means. As a variation this embodiment of the apparatus may also comprise a pressure loss device of the type indicated by 7 and 8 in FIGS. 4 to 6. It may also be provided with a fluid injection device of the type shown in FIGS. 7 to 9 either on both sides of the cast metal slab 11 or only on its lower side.

The apparatus of the present invention may also be used either in only the curved portion or the horizontal portion of the cast metal path with the other portion constructed in the conventional manner.

I claim:

1. In an apparatus for continuous casting of strands, particularly steel strands, including a mould, mould cooling means, a set of guide rollers arranged to guide the strand coming out of the mould along a desired path, and means for cooling and advancing the strand along its path, an improvement wherein at least in a portion of the zone of solidification of the strand after the mould, the set of guide rollers is arranged in an airtight chamber provided with injection nozzles for cooling liquid, the chamber having opposite ends with a seal at each end and at least one outlet opening equipped with flow control valve means, said guide rollers being arranged to guide the strand coming out of the mould along a first path in which the strand has a vertical component of travel and then along a second substantially horizontal path, said airtight pressurized chamber surrounding the rollers in said first path being divided into compartments separated from one another by horizontal partitions each provided with an opening for the passage of the strand, each compartment being provided on both sides of said path with at least one said injection nozzle for cooling liquid, said compartments being connected to one another through pressure control valve means.

2. Apparatus as claimed in claim 1 wherein the openings for the passage of the strand in said partitions separating said compartments are so dimensioned that there is little clearance between the edge of each opening and the strand and said clearance decreases progressively in the direction of movement of the strand.

3. Apparatus as claimed in claim 1 wherein said pressure control valve means comprises by-pass valves.

4. Apparatus as claimed in claim 1 wherein the portion of said airtight pressurized chamber surrounding the rollers forming said substantially horizontal path is divided longitudinally into an upper and a lower portion by a pressure reducing device arranged on each side of the passage of the strand.

5. Apparatus as claimed in claim 4 wherein said pressure reducing device comprises horizontal partitions each provided with an opening for the passage of the strand.

6. Apparatus as claimed in claim 1 wherein at least one said injection nozzle is arranged in an injection box.

7. Apparatus as claimed in claim 6 wherein said injection box is provided with a rim constructed as a labryinth pressure reducing device.

8. Apparatus as claimed in claim 6 wherein said injection boxes are arranged in staggered arrangement in front of at least one of the major surfaces of the strand.

9. Apparatus as claimed in claim 1 wherein said outlet opening is arranged in the vicinity of the mould, and comprising a recycling system for steam connecting said valved outlet opening to said injection nozzles.

10. Apparatus as claimed in claim 9 wherein said recycling system for steam comprises a condenser having an inlet connected to said valved outlet opening and an outlet connected through a pump to said injection nozzles.

11. Apparatus as claimed in claim 1 comprising a second valved outlet opening located in the downstram portion of said first path and connected through a second steam recycling system to the injection nozzles located in said path.

12. Apparatus as claimed in claim 1 wherein said first path is curved.

13. Apparatus as claimed in claim 1 wherein said first path is vertical.

* * * * *